United States Patent [19]

Botker

[11] Patent Number: 5,070,518

[45] Date of Patent: Dec. 3, 1991

[54] COIN COUNTING CONTROL APPARATUS FOR A VENDING MACHINE

[75] Inventor: Kurt Botker, Thurmont, Md.

[73] Assignee: North American Philips Corp., New York, N.Y.

[21] Appl. No.: 480,692

[22] Filed: Feb. 14, 1990

[51] Int. Cl.[5] ..... G07F 5/00; G06M 3/02

[52] U.S. Cl. ..... 377/7; 377/16; 194/218

[58] Field of Search ..... 377/7, 16; 194/215, 194/218

[56] References Cited

U.S. PATENT DOCUMENTS

| | | | |
|---|---|---|---|
| 3,841,456 | 10/1974 | Levasseur | 194/18 |
| 4,258,837 | 3/1981 | Manos et al. | 377/7 |
| 4,376,479 | 3/1983 | Sugimoto et al. | 194/18 |
| 4,429,778 | 2/1984 | Levasseur | 194/18 |
| 4,753,625 | 6/1988 | Okada | 377/7 |

*Primary Examiner*—John S. Heyman

*Attorney, Agent, or Firm*—Steven R. Biren

[57] ABSTRACT

A coin counting apparatus for a vending machine includes a down counter which is loaded with an initial count representing the number of coins to be deposited in order to initiate a vend cycle which initial count is decremented in response to each sequential coin detection. A display responsive to the current count of the counter indicates the number of coins yet to be deposited and a gate detecting the target count of zero is coupled to actuate relay contacts to signal the vending machine to initiate a vend cycle. An initialization circuit causes the loading of the initial count in response to either the detection of power up or the expiration of a predetermined time period, in the range of 1 to 10 minutes, after the last coin detection.

9 Claims, 1 Drawing Sheet

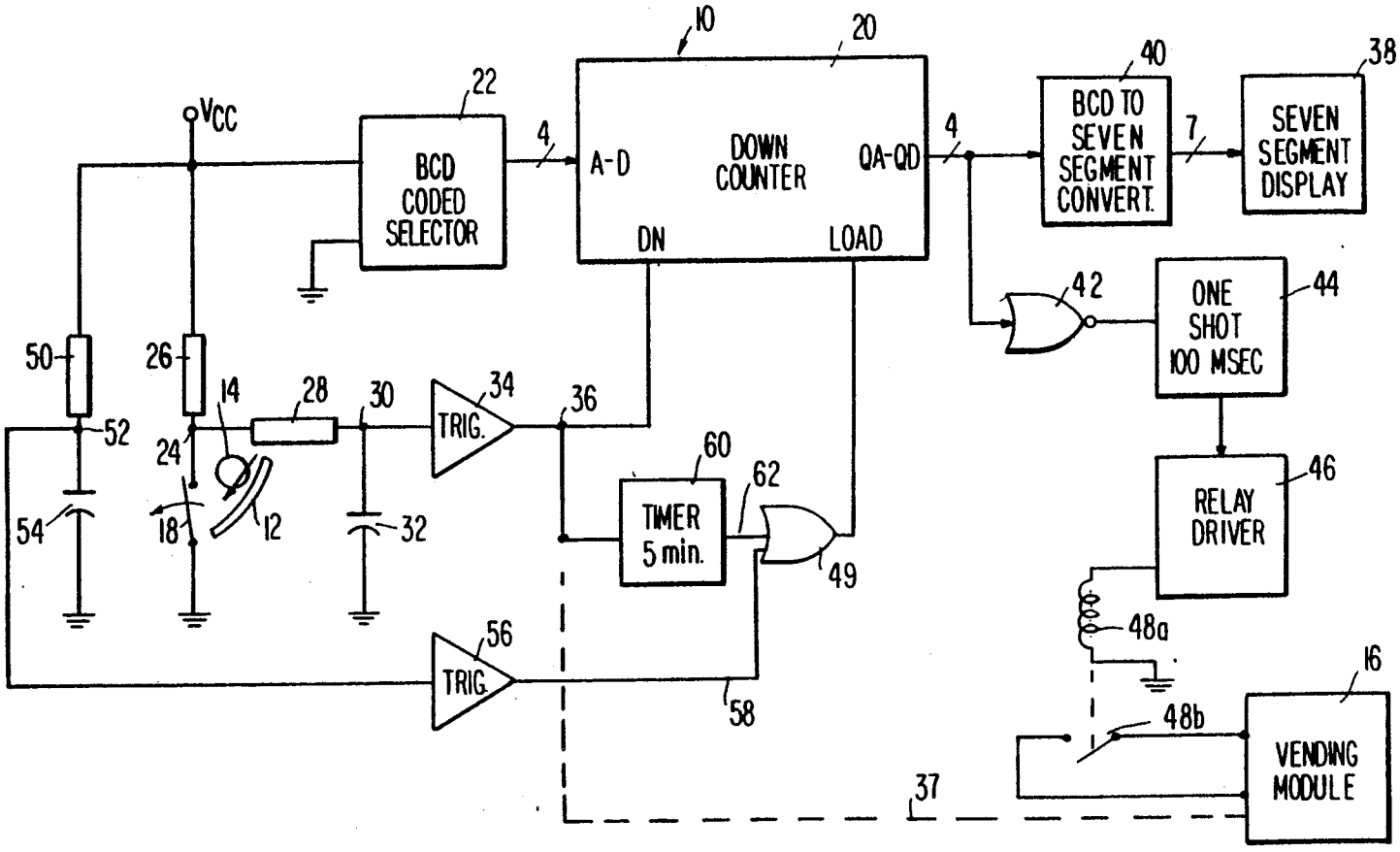
SEVEN SEGMENT DISPLAY
38
BCD TO SEVEN SEGMENT CONVERT.
40
7
4
ONE SHOT 100 MSEC
44
RELAY DRIVER
46
VENDING MODULE
16
42
48a
48b
37
DOWN COUNTER
20
10
QA-QD
LOAD
DN
A-D
49
62
60
TIMER 5 min.
58
36
4
BCD CODED SELECTOR
22
34
TRIG.
56
TRIG.
30
32
28
12
14
VCC
26
24
18
52
50
54

COIN COUNTING CONTROL APPARATUS FOR A VENDING MACHINE

BACKGROUND OF THE INVENTION

1. Related Applications

The present application is related to my prior application which will issue on Feb. 20, 1990 as U.S. Pat. No. 4,903,282.

2. Field of the Invention

The present invention relates to coin counters for counting from an initial count state to a final count state, which is reached by the detection of deposit of a predetermined number or value of coins, and for signalling that a vend cycle be initiated in response to reaching the final count state. In its particular aspects, the present invention relates to a coin counter which is set to the initial count state in response to the expiration of a predetermined time period after the deposit of the last coin, irrespective of the count state of the counter.

3. Description of the Prior Art

In prior art vending machines, whether for dispensing a product or a service, it is common to reset the coin or monetary value (hereafter referred to as "coinage") counting elements to an initial count state only in response to the detection of a final count state, which is the state required to initiate a vend cycle, or in response to the detection of a power up. Illustrative is U.S. Pat. No. 4,258,837 Manos et al. If less than sufficient coinage to initiate a vend cycle has been deposited in such prior art vending machines, in the absence of temporary power loss, such counting elements will remain indefinitely in the intermediate count state corresponding to the insufficient deposited coinage. While it is generally appropriate to give the next consumer the credit for this unearned coinage, a lack of knowledge of or attention to the existence of said previously deposited coinage has caused problems with respect to the operation of those vending machines which require the consumer to do something before the vend. For example, with respect to coin operated washers or dryers, premature initiation of the vend cycle may occur before the consumer has loaded his laundry.

Furthermore, in the use of existing coin counting apparatus for vending machines, which may require the deposit of a relatively large number of coins to initiate operation of the machine, consumers have become confused as to the number of coins already deposited or remaining to be deposited, resulting in frustration or premature initiation of the operation.

Some vending machines have the coin drop, coin detecting means, counting means, and final count detector integrated as a coin receiving module which supplies a detection signal to the vending module for the purpose of signalling the vending module to initiate a vend cycle, while other machines have only the coin drop and coin detecting means integrated as the coin receiving module which supplies a coin detection signal to the vending module. In the latter instance, the counting means and final count detector are integrated in the vending module, and said counting means may be structured that it retains a current count even in the event of a interruption in power.

SUMMARY OF THE INVENTION

It is an object of the present invention to provide a coin receiving module which will avoid those disadvantages of the prior art which have caused annoyance, frustration or confusion and yet will operate with vending modules of either aforementioned type. It is another object of the present invention to provide coin counting apparatus for controlling a vending machine in which coinage counts are not retained beyond a predetermined reasonable time period after the deposit of the last coin. It is still another object to provide in such coin counting apparatus, means for programming the required coinage to initiate a vend cycle and means for displaying numerically the coinage remaining to be deposited.

Briefly, the aforementioned and other objects are satisfied by providing coin counting apparatus in which the coin receiving module includes a counter for counting a predetermined number of counts representing the coinage necessary to initiate a vend cycle by having a current count which can be initialized to a predetermined initial count and can be changed, in response to coin detection by a coin responsive transducer, in a counting direction towards a final count which differs from the initial count by said predetermined number. The counter has a control input for controlling setting of the current count to the initial count which is fed by initialization control means that is in turn fed by the coin responsive transducer. The initialization control means includes a timer for timing the predetermined time period and is configured such that the current count is set to the initial count upon the expiration of the predetermined time period after the last coin detection. The initialization control means is also responsive to power up detection means.

In order to allow for a numerical display of coinage yet to be deposited to be controlled by or integrated with the coin receiving module if desired, the counter is mechanized as a down counter which is initialized by the initialization means with an initial count that is loaded from programmable means; the initial count represents the coinage deposit that is necessary to achieve a vend. The counter is decremented in response to each coin detection until a zero count is reached. Means are provided, when required by the type of vend module used, for signalling the vend module to initiate a vend cycle in response to detection of the zero count.

The predetermined time period is selected from the range of between 1 and 10 minutes, when the vend cycle is more than 10 minutes.

BRIEF DESCRIPTION OF THE DRAWING

Other objects, features and advantages of the present invention will become apparent upon perusal of the following detailed description of the preferred embodiment thereof when taken in conjunction with the appended drawing, wherein:

The sole FIGURE is a schematic block diagram of the coin counting apparatus of the present invention.

DETAILED DESCRIPTION OF THE PREFERRED EMBODIMENT

Referring to the sole FIGURE of the drawing, the coin counting apparatus of the present invention comprises a coin receiving module, indicated generally by the reference numeral 10 as including all shown in said FIGURE but an associated vending module 16 such as a washer or dryer. Coin receiving module 10 comprises a coin drop 12 for receiving coins 14 of a predetermined denomination ,such as quarters, sequentially deposited therein for the purpose of obtaining a vend by vending module 16. A coin responsive switch 18 or other transducer is positioned relative to coin drop 12 for detecting each genuine coin deposited, it being be understood that well known means not pertinent to the present invention are provided for rejecting or inhibiting the counting of slugs or other spurious articles.

The heart of coin receiving module 10 is a down counter BCD decade 20 (which is in fact an up/down counter used only in the down mode) which has inputs A–D for receiving a four bit wide parallel BCD input number from a restricted access settable or programmable selector switch means 22; the input number equals the number of coins necessary to initiate a vend cycle. The four bit wide parallel outputs QA–QD of counter 20 indicate the current count of the counter. In response to a control signal on a LOAD input of the counter caused by means which will be better understood as the discussion proceeds, the input number programmed in the selector 22 is loaded into the counter as an initial current count, which appears in BCD form on outputs QA–QD.

The aforesaid initial current count is decremented by one in response to each coin detection by the transducer switch 18. In order to accomplish this, the normally closed contacts of switch 18 are respectively connected to ground and to a node 24 while a resistor 26 is connected between node 24 and the positive DC supply voltage Vcc. Furthermore, a resistor 28 is connected between node 24 and a node 30 while a capacitor 32 is connected between node 30 and ground. Node 30 feeds a Schmitt trigger 34 whose output 36 feeds the down count input, DN, of counter 20. When the contacts of switch 18 open in response to a coin 14 in coin drop 12, the capacitor 32 is charged via resistors 26 and 28 causing the voltage at node 30 to rise toward Vcc. The time constant of said rising voltage is preferably on the order of 20–25 msec to reliably detect each coin while rejecting contact bounce caused by the coin or by a mechanical shock applied to the coin receiving module 10 in an attempt to circumvent the operation thereof. As this voltage exceeds the operate point of trigger 34, the trigger changes its output 36 to a digital one state which causes decrementing by one the current count in counter 20. If vending module 16 is of the type which includes its own counting means then output 36 is also fed to vending module 16 on line 37.

It should now be apparent that the current count of the counter represents the number of coins yet to be deposited to initiate a vend cycle. When it is desired to include a numerical display in module 10 for this number, a seven segment type numerical display 38 is provided driven by a BCD to seven segment converter 40 that is fed by the current count outputs QA–QD of counter 20. If vending module 16 is of the type requiring a signal to initiate a vend cycle then means are provided in module 10 for providing such a signal when the current count has been decremented to the final or target count of zero, indicating the deposit of the necessary number of coins. This is accomplished by feeding the current count outputs QA–QD to a NOR gate which in response to the all zeros input state forms a state at its output, which is connected to the input of a one shot 44, for initiating a pulse at the output of the one shot having a duration of about 100 msec. The output of one shot 44 feeds a relay driver 46 which energizes the relay coil 48*a* to close the associated relay contacts 48*b* for the duration of said pulse. This contact closure signals vending machine 16 to initiate a vend cycle.

In accordance with the principles of the present invention, the counter 20 is initialized by loading the number at its inputs A–D as the current count in response to either a power up or the expiration of a predetermined time period after the last coin detected which causes a digital one state at the output of an OR gate 49 which feeds the LOAD control input of counter 10. The initialization means comprises a power up detector formed by a resistor 50 connected between the supply Vcc and a node 52 and a capacitor 54 connected between node 52 and ground. Node 52 feeds a Schmitt trigger 56 having an output 58. When power is turned on or restored after a power interruption Vcc will appear and the voltage at node 52 will rise toward Vcc. As this voltage reaches the operate point of trigger 56, the output 58, feeding one input of OR gate 49, will go to a digital one state.

The initialization means further comprises a timer 60 which is fed by the output 36 of the coin detection trigger 34. Timer 60 has a normal digital zero state at its output 62, which feeds the other input of OR gate 49, and times a predetermined time period which is commenced by its input going from a digital zero state to a digital one state. This time period is restarted each time the same state transition occurs at the input of timer 60 even though a previously started time period has not yet expired. When the possibly restarted predetermined time period expires, output 62 goes to a digital one state which state transition indicates the expiration of the predetermined time period after the last coin detection. Providing the vend cycle is of sufficiently long duration that initialization occurs during the vend cycle, the predetermined time period is chosen from the range of 1 to 10 minutes, and preferably about 5 minutes. Such range allows a consumer a more than reasonable delay between successive coin deposits. However, the setting of the counter 20 to the initial count after the expiration of the predetermined time period, rather than giving the next consumer credit for the unearned deposit, particularly when converter 40 and display 38 are not provided, protects the consumer from premature initiation of the vend cycle. Furthermore, if the vending module 16 is of the type which includes its own counting means, the current count of counter 20 may not correspond with the number of coins yet to be deposited as indicated by the counting means of vending module 16, due to such events as power interruptions. Even in such instance, the technique of the present invention for initializing the coin count of counter 20 assures the attainment during each vend cycle of synchronization between the coin counts carried by the coin receiving module and the vending module.

While the present invention has been described in particular detail with respect to coin counting apparatus for single denomination coins, as is common for coin operated washers and dryers, it should be appreciated that the principles of the invention are equally applicable to coin counting apparatus for receiving multiple denomination coins. In such instance, the initial count loaded into the counter 20 may represent the number of coins of the lowest denomination necessary to initiate a vend and the counter may decremented for each coin, with a number of pulses applied to the DN input representing the denomination of the detected coin expressed as a multiple of the lowest denomination. Accordingly numerous modifications are possible in to the details of the exemplary embodiment within the intended spirit and scope of the invention.

What is claimed is:

1. A coin counting apparatus for a vending machine comprising:

programmable means for forming a signal representation of a number of coins of a predetermined denomination necessary to initiate a vend cycle;

a down counter having a data input coupled to said programmable means for receiving said signal representation as initial count data at said data input, a control input controlling loading of said initial count data into said counter, a data output representing the current count of said counter, and a down count input for controlling decrementing said current count;

coin receiving means for the deposit of coins of said denomination to operate the vending machine;

coin responsive transducer means for detecting individual coins deposited in said coin receiving means, said coin responsive transducer means being coupled to said down count input for decrementing said current count by one in response to each coin detection until a zero count is reached to start said vending machine;

power up detection means for detecting power up of said coin counter; and load control means including timer means connected to said control input and responsive to said power up detection means and to said coin responsive transducer means for causing reloading of said initial count data into said counter in response to either detecting of power up or the expiration of a predetermined time period set by said timer means after the last coin detection, irrespective of whether, prior to said loading, the current count of said counter is zero.

2. The apparatus as claimed in claim 1, further comprising display means coupled to the data output of said counter for displaying said current count.

3. The apparatus as claimed in claim 1, further comprising means coupled to the data output of said counter for detecting when zero is the current count of said counter.

4. The apparatus as claimed in claim 1, wherein said predetermined time period is more than 1 minute and less than 10 minutes.

5. A coin counting apparatus for a vending machine comprising:

a counter for counting a predetermined number of counts representing a coinage necessary to initiate a vend cycle by having a current count which can be initialized to a predetermined initial count and can be changed by one at a time in a counting direction up to a final count which differs from the initial count by said predetermined number of counts, said counter having a control input for controlling setting of the current count to said initial count, a data output representing the current count of said counter, and a count input for controlling changes of said current count in said counting direction;

coin receiving means for the deposit of coins to operate the vending machine;

coin responsive transducer means for detecting individual coins deposited in said coin receiving means, said coin responsive transducer means being coupled to said count input for changing said current count in said counting direction in response to each coin detection until said final count is reached to start said vending machine; and initialization control means including timer means connected to said control input and responsive to said coin responsive transducer means for causing resetting of said current count to said initial count in response to the expiration of a predetermined time period from said timer means after the last coin detection, irrespective of whether prior to the setting of the current count, said current count is equal to said final count.

6. The apparatus as claimed in claim 5, further comprising display means coupled to the data output of said counter for displaying said current count.

7. The apparatus as claimed in claim 5, further comprising vend cycle initiation means coupled to the data output of said counter for signalling the vending machine to initiate a vend cycle in response to detection of the final count as the current count of said counter;

8. The apparatus as claimed in claim 5, wherein said predetermined time period is more than 1 minute and less than 10 minutes.

9. The apparatus as claimed in claim 5, further comprising power up detection means for detecting power up of said coin counter, and wherein said initialization control means is also fed by said power up detection means for causing setting said current count to said initial count also in response to the detection of power up.

* * * * *